US006293839B1

(12) United States Patent
Tsunoda et al.

(10) Patent No.: US 6,293,839 B1
(45) Date of Patent: Sep. 25, 2001

(54) OUTBOARD ENGINE SYSTEM

(75) Inventors: Masaki Tsunoda; Hiroki Tawa, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/297,082

(22) PCT Filed: Dec. 19, 1997

(86) PCT No.: PCT/JP97/04703

§ 371 Date: May 14, 1999

§ 102(e) Date: May 14, 1999

(87) PCT Pub. No.: WO98/27325

PCT Pub. Date: Jun. 25, 1998

(30) Foreign Application Priority Data

Dec. 19, 1996 (JP) ..... 8-340214
Dec. 19, 1996 (JP) ..... 8-340215

(51) Int. Cl.[7] ..... B63H 20/00
(52) U.S. Cl. ..... 440/88; 123/179.28
(58) Field of Search ..... 440/77, 88, 900; 123/179.28

(56) References Cited

U.S. PATENT DOCUMENTS 5,041,034 * 8/1991 Sakamoto ..... 440/88
5,049,100 * 9/1991 Yamamoto et al. ..... 440/88
5,370,563 * 12/1994 Yamazaki et al. ..... 440/77
5,445,547 * 8/1995 Furukawa ..... 440/77
5,694,895 * 12/1997 Tsunoda et al. ..... 123/179.28
5,743,228 * 4/1998 Takahashi ..... 440/77
5,778,847 * 7/1998 Takahashi et al. ..... 440/88
5,951,344 * 9/1999 Tsunoda et al. ..... 440/89

FOREIGN PATENT DOCUMENTS 57-123916 8/1982 (JP) .
59-74327 4/1984 (JP) .
60-95142 6/1985 (JP) .
62-93116 6/1987 (JP) .
62-153528 7/1987 (JP) .
5-312051 11/1993 (JP) .
6-33790 2/1994 (JP) .
6-123224 5/1994 (JP) .
6-147083 5/1994 (JP) .
8-100671 4/1996 (JP) .
8-261003 10/1996 (JP) .
9-189233 7/1997 (JP) .
9-254883 9/1997 (JP) .

* cited by examiner

*Primary Examiner*—Sherman Basinger
(74) *Attorney, Agent, or Firm*—Arent Fox Kintner Plotkin & Kahn, PLLC

(57) ABSTRACT

An engine E is received vertically in an engine room 36 covered by an engine cover 4, and a generator 62 is arranged in a position above a front end of a crankcase 7 of the engine E and facing an opening $\mathbf{10}_1$ formed at a front of belt covers 10, 11. An air flowing from an air intake port $\mathbf{4}_1$ formed at a rear, upper portion of the engine cover 4, toward an intake opening $\mathbf{79}_1$, of an intake silencer 76 provided at a front, lower end of the engine room 36 cools the generator 62 disposed in a path of flow. A part of air in the engine room 36 is introduced into an interior of the belt covers 10, 11 through the opening $\mathbf{10}_1$ to be discharged outside from a ventilation port $\mathbf{75}_1$, and at that time the generator 62 is cooled by the air which passes through the opening $\mathbf{10}_1$.

14 Claims, 5 Drawing Sheets

OUTBOARD ENGINE SYSTEM

FIELD OF THE INVENTION

The present invention relates to an outboard engine system including an engine and a generator which are accommodated in an engine room covered with an engine cover.

DESCRIPTION OF THE RELATED ART

In general, an engine of an outboard engine system is accommodated within an engine room covered with an engine cover for waterproof. The engine cover is provided with an air intake port, and air introduced into the engine room through the air intake port is supplied to an auxiliary of an intake system of the engine such as an intake chamber. At this time, if the inside of the engine room is brought into a high temperature, the following problem is encountered: the temperature of the intake air rises to reduce the engine output.

There are outboard engine systems which are known from Japanese Utility Model Application Laid-open No.60-95142 and Japanese Patent Application Laid-open Nos.62-153528 and 6-33790, in which a generator which is belt-driven by a crankshaft is disposed in an engine room.

In the outboard engine system described in the Japanese Patent Application Laid-open No.6-33790, an intake opening in the intake system auxiliary and the generator are disposed in a separated manner within the engine room in order to prevent the generator from drawing water thereinto with air. In this outboard engine system, however, the cooling and ventilation of the generator its surroundings are not taken into consideration and for this reason, there is a possibility that the surroundings around the generator may be brought into a high temperature to raise the temperature of the intake air.

In general, the generators driven by the engine of the outboard engine system include a generator which is accommodated within a flywheel mounted on a crankshaft, and a generator which is disposed on an axis different from that of the crankshaft and is belt-driven by the crankshaft, as described in the above Japanese Patent Application Laid-open No.6-33790. If the generator is disposed on the axis different from that of the crankshaft, as described above, it is possible to easily replace the generator by any generator having different performance and size in accordance with the object.

In the outboard engine system described in the above Japanese Patent Application Laid-open No.6-33790, the generator is disposed on a side of an engine block, and for this reason, the following problem arises: the lateral dimension of the outboard engine system is increased, which is disadvantageous, when the outboard engine system is steered so that it is turned to the left or right, or when two outboard engine systems are used in a tandem manner. Especially, when the cylinders are arranged In series or in line, the outboard engine system is of such a shape that the generator protrudes ore largely than the width dimension of the engine block.

DISCLOSURE OF THE INVENTION

The present invention has been accomplished with the above circumstances in view, and it is a first object of the present invention to ensure that the generator accommodated in the engine room is cooled effectively to prevent the rising of the temperature of intake air.

It is a second object of the present invention to reduce the lateral dimension of the outboard engine system by disposing the generator in a reasonable layout within the engine room.

To achieve the first object, according to a first aspect and feature of the present invention, there is provided an outboard engine system comprising an engine, an intake system auxiliary and a generator which are accommodated within an engine room covered with an engine cover having an air intake port, characterized in that the generator is disposed in an intermediate portion of a path of air flow from the air intake port to an intake opening in the intake system auxiliary.

With the above arrangement, the generator is disposed in the intermediate portion of the path of air flow from the air intake port provided in the engine cover covering the engine room to the intake opening in the intake system auxiliary. Therefore, the generator can be cooled by air having a low temperature to lower the temperature of the inside of the engine room and to prevent the rising of the temperature of intake air.

To achieve the first object, according to a second aspect and feature of the present invention, there is provided an outboard engine system comprising an engine, an intake system auxiliary and a generator which are accommodated within an engine room covered with an engine cover having an air intake port and a ventilation port, characterized in that the generator is disposed in an intermediate portion of a path of air flow from the air intake port to the ventilation port.

With the above arrangement, the generator is disposed in the intermediate portion of the path of air flow from the air intake port to the ventilation port provided in the engine cover covering the engine room. Therefore, the generator can be cooled by air having a low temperature, and the warmed air can be discharged from the ventilation port to lower the temperature of the inside of the engine room and to prevent the rising of the temperature of intake air.

To achieve the first object, according to a third aspect and feature of the present invention, there is provided an outboard engine system comprising an engine, an intake system auxiliary and a generator which are accommodated within an engine room covered with an engine cover having an air intake port and a ventilation port, characterized in that the generator is disposed in an intermediate portion of a path of air flow from the air intake port to an intake opening in the intake system auxiliary and in an intermediate portion of a path of air flow from the air intake port to the ventilation port.

With the above arrangement, the generator is disposed in he intermediate portion of the path of air flow from the air intake port provided in the engine cover covering the engine room to the intake opening in the intake system auxiliary and in the intermediate portion of the path of air flow from the air intake port to the ventilation port. Therefore, the generator can be cooled effectively by air having a low temperature, and the warmed air can be discharged from the ventilation port to lower the temperature of the inside of the engine room and to prevent the rising of the temperature of intake air.

To achieve the second object, according to a fourth aspect and feature of the present invention, there is provided an outboard engine system comprising an engine accommodated within an engine room covered with an engine cover, and a generator disposed on an axis different from that of a crankshaft of the engine and driven by the crankshaft, characterized in that the generator is disposed between a front or rear surface of an engine block and an inner surface of the engine cover.

With the above arrangement, the generator is disposed between the front or rear surface of the engine block and the inner surface of the engine cover. Therefore, the generator can be accommodated compactly within the engine room, while maintaining the increase in lateral dimension of the outboard engine system to the minimum. The terms "longitudinal" and "lateral" used herein are defined to indicate the longitudinal and lateral directions of the outboard engine system (the side of a s tern bracket mounted to a stern is front).

In addition to the fourth feature, if any one of the following arrangements is employed, the increase in lateral dimension of the outboard engine system can be maintained to the minimum: an arrangement in which an intake passage is disposed longitudinally along a side of the engine block; an arrangement in which an intake passage is disposed longitudinally along one of left and right sides of the engine block, and an exhaust passage is vertically defined on the other side; an arrangement in which an electric equipment box is disposed along a side of the engine block, the lateral dimension of the electric equipment box being smaller than the longitudinal and vertical dimensions of the electric equipment box; an arrangement in which an intake passage is disposed longitudinally along one of left and right sides of the engine block, and an electric equipment box is disposed along the other side, the lateral dimension of the electric equipment box being smaller than the longitudinal and vertical dimensions of the electric equipment box; and an arrangement in which an intake passage is disposed longitudinally along one of left and right sides of the engine block, an exhaust passage is vertically defined on the other side, and an electric equipment box is disposed along the other side, the lateral dimension of the electric equipment box being smaller than the longitudinal and vertical dimensions of the electric equipment box.

In addition to the fourth feature, if an arrangement in which an oil filter and the generator are disposed in a vertically distributed manner on a front or rear surface of the engine block, or an arrangement in which an oil filter and the generator are disposed in a laterally distributed manner on a front or rear surface of the engine block, is employed, the oil filter and the generator can be accommodated compactly within the engine room, while avoiding an increase in longitudinal dimension of the outboard engine system and the creation of a dead space.

BRIEF DESCRIPTION THE DRAWINGS

FIGS. 1 to 5 show an embodiment of the present invention, where in

FIG.1 is a side view of the entire arrangement of an outboard engine system;

FIG. 2 is an enlarged sectional view taken along a line 2—2 in FIG. 1;

FIG. 3 is a view taken in the direction of an arrow 3 in FIG. 2;

FIG. 4 is a view taken in the direction of an arrow 4 in FIG. 3; and FIG. 5 is a view for explaining the operation.

BEST MODE FOR CARRYING OUT THE INVENTION

A mode for carrying out the present invention will now be described by way of an embodiment with reference to FIGS. 1 to 5.

Figure 1:
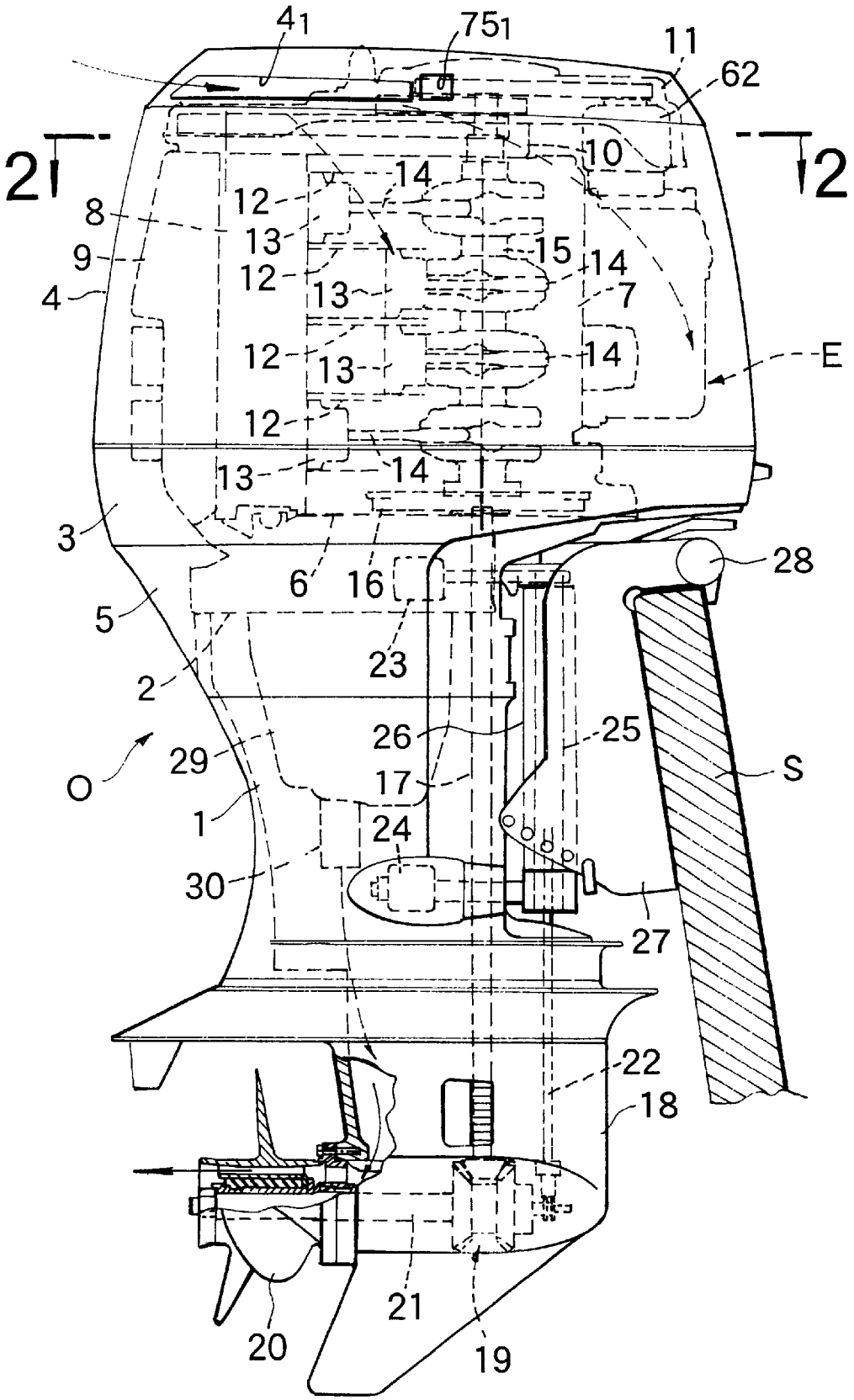

As shown in FIG. 1, an outboard engine system O includes a mount case 2 coupled to an upper portion of an extension case 1. A water-cooled serial 4-cylinder and 4-cycle engine E is supported on an upper surface of the mount case 2 with a crankshaft 15 disposed vertically. An under-case 3 having an upper surface opened is coupled to the mount case 2, and an engine cover 4 is detachably mounted on an upper portion of the under-case 3. An under-cover 5 is mounted between a lower edge of the under-case 3 and an edge of the extension case 1 near its upper end so as to cover an outside of the mount case 2.

The engine E includes a cylinder block 6, a crankcase 7, a cylinder head 8, a head cover 9, a lower belt cover 10 and an upper belt cover 11. Lower surfaces of the cylinder block 6 and the crankcase 7 are supported on the upper surface of the mount case 2. Pistons 13 are slidably received in four cylinders 12 defined in the cylinder block 6 and are connected to the crankshaft 15 disposed vertically, through connecting rods 14.

A driving shaft 17 connected to a lower end of the crankshaft 15 along with a flywheel 16 extends downwards within the extension case 1 and is connected at its lower end to a propeller shaft 21 having a propeller 20 at its rear end, through a bevel gear mechanism 19 provided within a gear case 18. A shift rod 22 is connected at its lower end to a front portion of the bevel gear mechanism 19 to change over the direction of rotation of the propeller shaft 21.

A swivel shaft 25 is fixed between an upper mount 23 provided on the mount case 2 and a lower mount 24 provided on the extension case 1. A swivel case 26 for rotatably supporting the swivel shaft 25 is vertically swingably carried on a stern bracket 27 mounted at a stern S through a tilting shaft 28.

An oil pan 29 and an exhaust pipe 30 are coupled to a lower surface of the mount case 2. An exhaust gas discharged from the exhaust pipe 30 into a space within the extension case 1 is discharged through a space within the gear case 18 and the inside of the a boss portion of the propeller 20 into the water.

Figure 2:
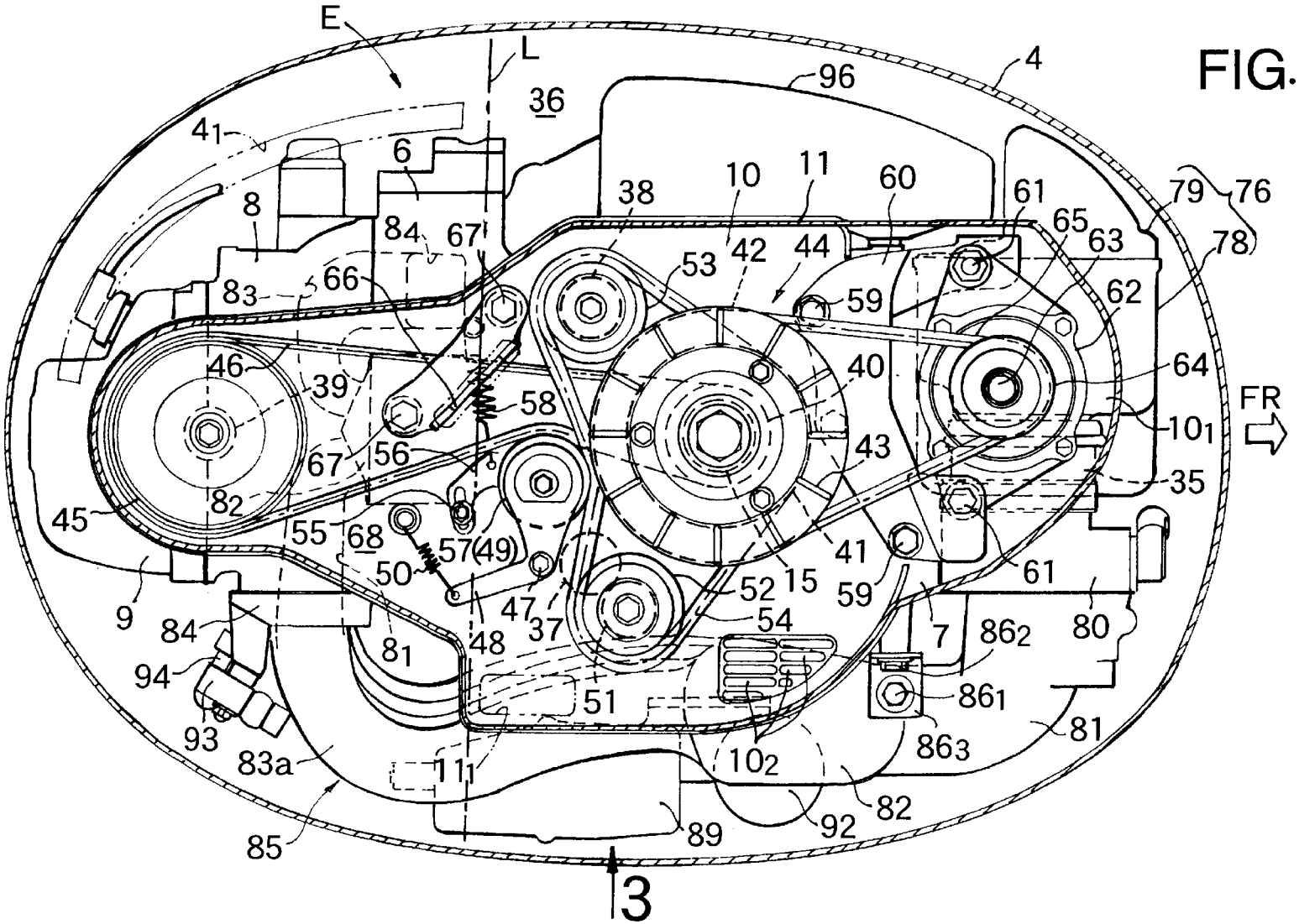

As can be seen from FIG. 2, the engine E accommodated in an engine room 36 defined by the under-case 3 and the engine cover 4 includes two secondary balancer shafts 37 and 38 disposed in parallel to the crankshaft 15, and a single cam shaft 39. The secondary balancer shafts 37 and 38 are supported in the cylinder block 6 at locations nearer the cylinder head 8 than the crankshaft 15, and the cam shaft 39 is supported on mating faces of the cylinder head 8 and the head cover 9.

A pulley assembly 44 is fixed to an upper end of the crankshaft 15 and comprised of a cam shaft drive pulley 40, a secondary balancer shaft drive pulley 41, a generator drive pulley 42 and a cooling fan 43 which are formed integrally with one another. A cam shaft follower pulley 45 fixed to an upper end of the cam shaft 39 and the cam shaft drive pulley 40 are connected to each other by an endless belt 46. The diameter of the cam shaft drive pulley 40 is set at one half of the diameter of the cam shaft follower pulley 45, so that the cam shaft 39 is rotated at a speed which is one half of the speed of the crankshaft 15. A tension pulley 49 mounted at one end of an arm 48 pivotally supported by a pin 47 is urged against an outer surface of the endless belt 46 by the resilient force of a spring 50, thereby providing a predetermined tension to the endless belt 46.

A pair of secondary balancer shaft follower pulleys 52 and 53 are fixed respectively to an intermediate shaft 51 mounted in the vicinity of one of the secondary balancer shaft 37 and to the other secondary balancer shaft 38. The secondary balancer shaft follower pulleys 52 and 53 and the secondary balancer shaft drive pulley 41 are connected to each other by the endless belt 54. A tension pulley 57 is mounted at one end of an arm 56 pivotally supported by a pin 55 and urged against an outer surface of the endless belt 54 by the resilient force of a spring 58, thereby providing a predetermined tension to the endless belt 54. An intermediate shaft 51 and the one secondary balancer shaft 37 are interconnected by a pair of gears (not shown) having the same diameter, and the diameter of the secondary balancer shaft drive pulley 41 is set at two times the diameter of the secondary balancer shaft follower pulleys 52 and 53. Therefore, the pair of secondary balancer shafts 37 and 38 are rotated in opposite directions at a speed two times that of the crankshaft 15.

A generator 62 is supported by two bolts 61, 61 on a bracket 60 which is fixed to an upper surface of the crankcase 7 by two bolts 59, 59. A generator follower pulley 64 fixed to a rotary shaft 63 of the generator 62 and the generator drive pulley 42 are interconnected by the endless belt 65, and the generator 62 is driven by the crankshaft 15. Since the generator 62 is mounted separately from the engine E in the above manner, the general-purpose generator 62 can be used, which is convenient for the cost and moreover, the capacity of the generator 62 can easily be increased, as compared with the case where the generator is incorporated into the flywheel mounted on the crankshaft 15.

An engine hanger 66 engaged by a hook of a chain block or a crane in hanging down the outboard engine system O is fixed by two bolts 67, 67 between the cam shaft 39 and the other secondary balancer shaft 38. The engine hanger 66 is positioned slightly at the rear of the position of the gravity center of the outboard engine system O, and it is taken into consideration that the outboard engine system O hung down by the engine hanger 66 can easily be mounted at and removed from the stern S as a forward-leaned attitude in which the lower end of the outboard engine system has leaped up slightly rearwards.

Three belts 46, 54 and 65 for driving the cam shaft 39, the secondary balancer shafts 37 and 38 and the generator 62 are accommodated in a belt chamber 68 defined by the lower and upper belt covers 10 and 11. The lower belt cover 10 has an opening $\mathbf{10}_1$ surrounding the periphery of the generator 62, and a plurality of slits $\mathbf{10}_2$ in its bottom wall on the right of the crankshaft 15, so that air is introduced into the belt chamber 68 through the opening $\mathbf{10}_1$, and the slits $\mathbf{10}_2$. An upper end of the engine hanger 66 protrudes upwards through the upper belt cover 11.

Figure 3:
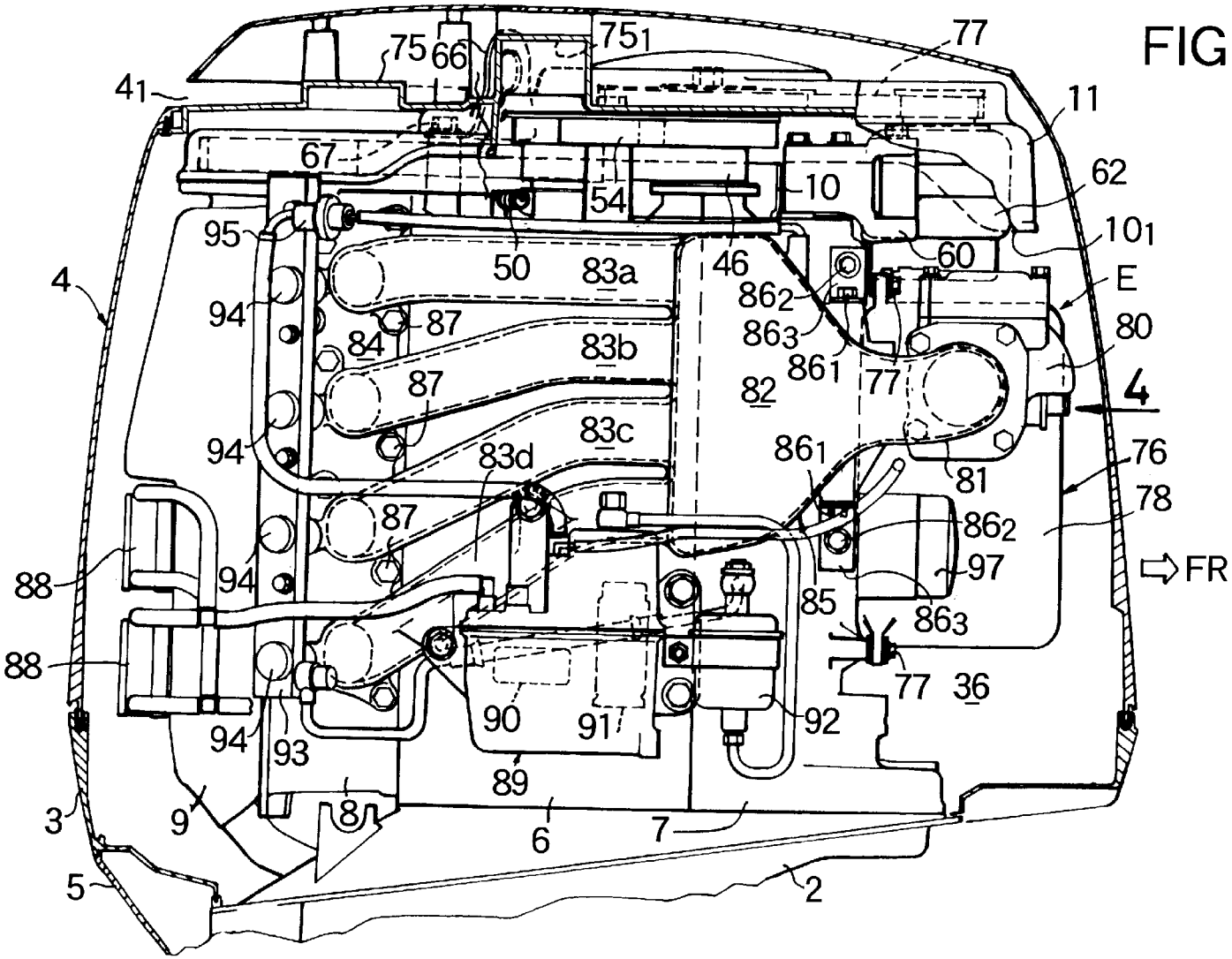
Figure 4:
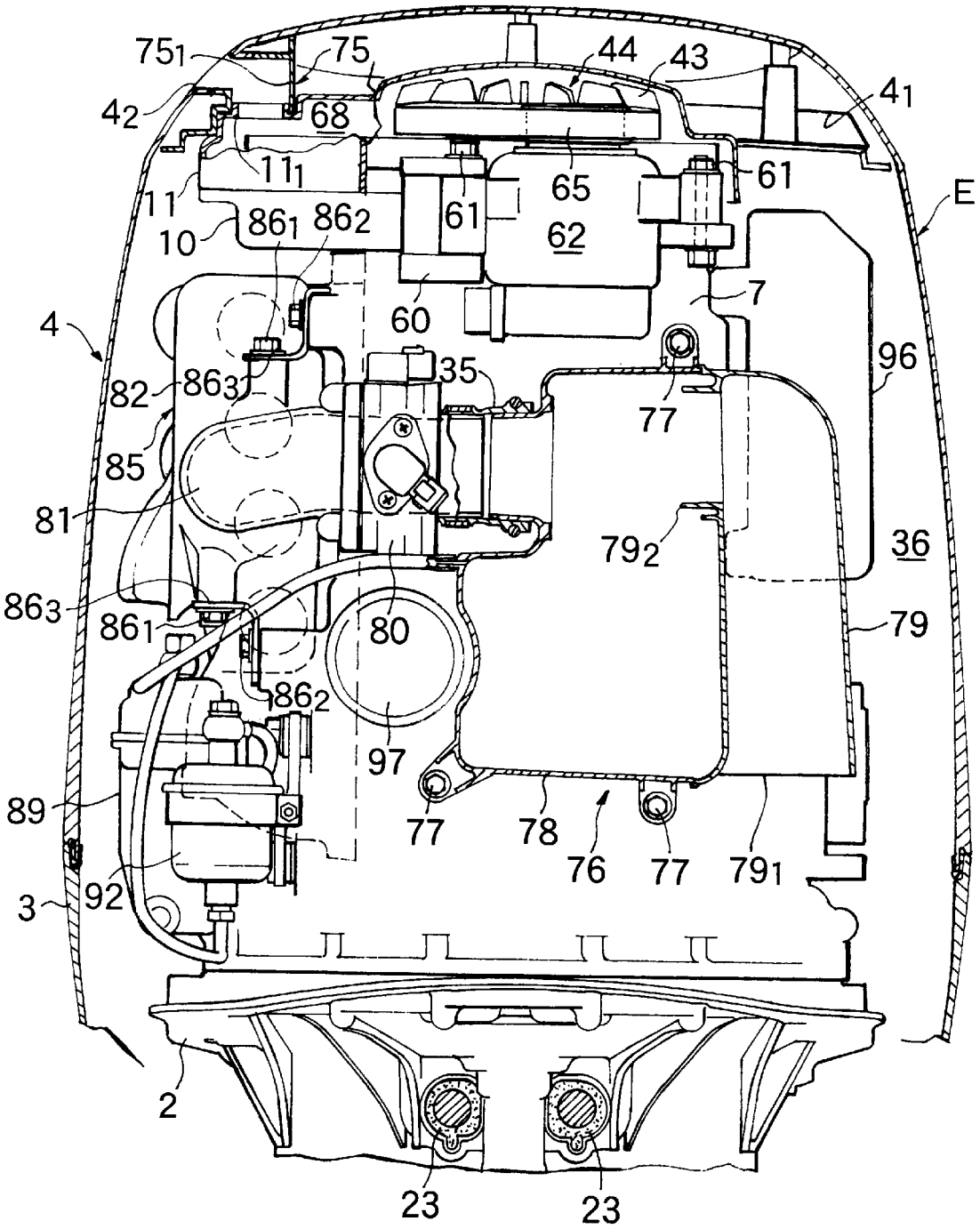

As can be seen from FIGS. 2 to 4, a pair of left and right slit-shaped air intake bores $\mathbf{4}_1$, $\mathbf{4}_1$ (FIG. 2 shows only the left side) are defined in a rear surface of an upper portion of the engine cover 4, and a guide plate 75 extending forwards from lower edges of the air intake bores $\mathbf{4}_1$, $\mathbf{4}_1$ is fixed to an inner surface of the engine cover 4. Therefore, air drawn from the air intake bores $\mathbf{4}_1$, $\mathbf{4}_1$ flows forwards through a space defined between an upper wall of the engine cover 4 and the guide plate 75 to enter the engine room 36 from a front edge (shown by a reference character L in FIG. 2) of the guide plate 75. A ventilating duct $\mathbf{75}_1$ (see FIG.4) is formed in a right side of the guide plate 75, so that its lower end communicates with an opening $\mathbf{11}_1$ defined in a right side of the upper belt cover 11 and its upper end communicates with an opening $\mathbf{4}_2$ defined in a right side of the upper portion of the engine cover 4. The ventilating duct $\mathbf{75}_1$ permits the belt chamber 68 surrounded by the lower and upper belt covers 10 and 11 to be put into communication with the open air, thereby performing the ventilation.

The structures of an intake system and a fuel supply system of the engine E will be described below with reference to FIGS. 2 to 4.

An intake silencer 76 is fixed to a front surface of the crankcase 7 by three bolts 77. The intake silencer 76 comprises a box-shaped body portion 78, and a duct portion 79 coupled to a left side of the body portion 78. The duct portion 79 has an intake opening $\mathbf{79}_1$ provided downwards in its lower end, and a communication bore $\mathbf{79}_2$ provided in its upper end to communicate with an internal space in the body portion 78. A throttle body 80 is disposed in a right side of the body portion 78 of the intake silencer 76 and connected to the body portion 78 through a short intake duct 35 having flexibility.

The throttle body 80 is connected and fixed to an intake manifold 85 which will be described below. The intake manifold 85 is disposed to extend along a right side of the engine E and is integrally provided with an elbow 81, a surge tank 82, four intake pipes 83*a*, 83*b*, 83*c* and 83*d* and a mounting flange 84. The elbow 81 serves to change the flow of intake air by approximately 90° from the flow along the front surface of the crankcase 7 to the flow along a right side of the crankcase 7. The elbow 81 may be a duct having flexibility, but is integral with the surge tank 82, the intake pipes 83*a*, 83*b*, 83*c* and 83*d* and the mounting flange 84 in order to support and fix the throttle body 80 in this embodiment.

The connection of the elbow 81 and the surge tank 82 of the intake manifold 85 is of a shape having a vertical dimension smaller than the upper and lower ends of the surge tank 82, and is fixed to the right sidewall of the crankcase 7 by bolts $\mathbf{86}_1$, $\mathbf{86}_1$; $\mathbf{86}_2$, $\mathbf{86}_2$ and two brackets $\mathbf{86}_3$, $\mathbf{86}_3$ each having a loose bore. Further, the mounting flange 84 is fixed to the right side of the cylinder head 8 by a plurality of bolts 87.

Two low-pressure fuel pumps 88, 88 are mounted in parallel to each other on a rear surface of the head cover 9, so that fuel is supplied from a fuel tank (not shown) mounted within a boat to a subsidiary tank 89 mounted on the right side of the cylinder block 6 by the low-pressure fuel pumps 88, 88. A float valve 90 for regulating the level of the fuel and a high-pressure fuel pump 91 are accommodated within the subsidiary tank 89, so that the fuel pressurized by the high-pressure fuel pump 91 is supplied via a high-pressure filter 92 to a lower end of a fuel rail 93. Four fuel injection valves 94 are mounted to the mounting flange 84 of the intake manifold 85 corresponding to the four cylinders 12, and the fuel is supplied from the fuel rail 93 to the fuel injection valves 94. A regulator 95 mounted at an upper end of the fuel rail 93 regulates the pressure of the fuel supplied to the fuel injection valves 94 and circulates the surplus fuel to the subsidiary tank 89.

As can be seen from FIG. 2, air flowing within the intake manifold 85 is mixed with the fuel injected from the fuel injection valves 94, and the mixture is supplied through an intake port $\mathbf{8}_1$ defined in the cylinder head 8 to a combustion chamber $\mathbf{8}_2$. An exhaust gas is discharged through an exhaust port $\mathbf{8}_3$ via an exhaust passage $\mathbf{8}_4$ to the exhaust pipe 30 (see FIG. 1). The exhaust passage $\mathbf{8}_4$ is defined vertically in a left side of the cylinder block 6 which is opposite from the intake manifold 85 disposed on the right side of the cylinder block 6.

Further, an electric equipment box 96 and a cartridge-type oil filter 97 are disposed within the engine room 36. The electric equipment box 96 is disposed along the left sides of the cylinder block 6 and the crankcase 7 and is formed with a small lateral dimension, as compared with its longitudinal and vertical dimensions. The electric equipment box 96 is compactly accommodated in a narrow space between the cylinder block 6 as well as the crankcase 7 and the inner surface of the engine cover 4. The cartridge-type oil filter 97 mounted on the front surface of the crankcase 7 is disposed below the generator 62 in the axial direction of the crankshaft 15 and in a distributed manner on the opposite sides of the crankshaft 15, whereby the space in the front portion of the engine room 36 is utilized effectively.

The operation of the embodiment of the present invention having the above-described arrangement will be described below.

When the crankshaft 15 is rotated by operation of the engine E, the cam shaft 39 is driven through the endless belt 46 and the cam shaft follower pulley 45 by the cam shaft drive pulley 40 of the pulley assembly 44 fixed to the crankshaft 15. In addition, the pair of secondary balancer shafts 37, 38 are driven through the endless belt 54, the secondary balancer shaft follower pulleys 52, 53 and the intermediate shaft 51 by the secondary balancer shaft drive pulley 41 of the pulley assembly 44 fixed to the crankshaft 15. Further, the generator 62 is driven through the endless belt 65 and the generator follower pulley 64 by the generator drive pulley 42 of the pulley assembly 44 fixed to the crankshaft 15.

Figure 5:
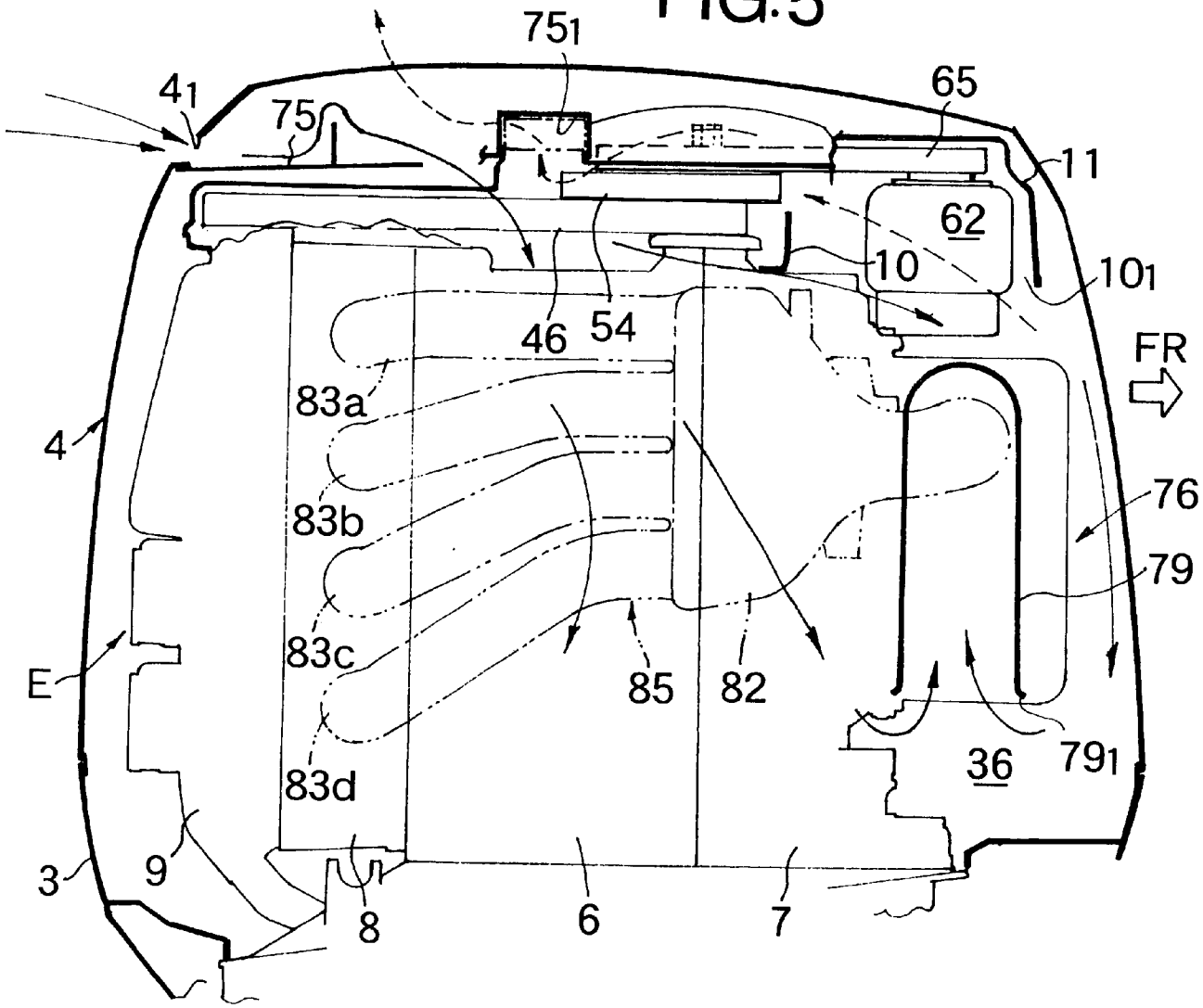

As can be seen from FIG. 5, the inside of the engine room 36 is brought into a negative pressure by the negative intake gas pressure generated with the operation of the engine E and hence, air is introduced along the upper surface of the guide plate 75 into the engine room 36 through the air intake ports $\mathbf{4}_1$, $\mathbf{4}_1$ formed at the rear of the engine cover 4. The air intake ports $\mathbf{4}_1$, $\mathbf{4}_1$ and the intake opening $\mathbf{79}_1$ in the intake silencer 76 are provided in a diagonal position of the engine room 36 each other, namely, the air intake ports $\mathbf{4}_1$, $\mathbf{4}_1$ are provided in a rear, upper portion of the engine room 36, and the intake opening $\mathbf{79}_1$ in the intake silencer76 is provided in a front, lower portion of the engine room 36 and hence, air is permitted to flow in the entire internal space in the engine room 36 around the outer periphery of the engine E, and is drawn through the intake opening $\mathbf{79}_1$ into the intake silencer 76.

The air drawn through the intake opening $\mathbf{79}_1$ is supplied via the duct portion 79 and the body portion 78 of the intake silencer 76 into the intake manifold 85 and further via the surge tank 82 of the intake manifold 85 and the intake pipes 83*a*, 83*b*, 83*c* and 83*d* into the combustion chambers $\mathbf{8}_2$ in the cylinders 12.

The generator 62 is mounted in front of and above the crankcase 7 located in the front portion of the engine room 36 and hence, the generator 62 is located in the flow path of the air flowing forwards along the upper wall of the engine cover 4 and downwards along the front wall of the engine cover 4, whereby the generator 62 which is an exothermic member and the section around the generator 62 can be cooled effectively.

That portion of the air introduced into the engine room 36, which is not drawn into the intake silencer 76, is introduced through the opening $\mathbf{10}_1$ and the slit $\mathbf{10}_2$ in the lower belt cover 10 into the belt chamber 68 where it is agitated by the cooling fan 43 mounted in the pulley assembly 44 to cool the endless belts 46, 54 and 65. Then, the air is discharged to the outside of the outboard engine system O via the ventilating duct $\mathbf{75}_1$. At this time, because the generator 62 is disposed to face the opening $\mathbf{10}_1$ in the lower belt cover 10, the generator 62 which is the exothermic member and the section around the generator 62 can be cooled effectively by the air which passes through the opening $\mathbf{10}_1$.

As described above, the generator 62 is cooled not only by the air introduced through the air intake ports $\mathbf{4}_1$, $\mathbf{4}_1$ in the engine cover 4 into the engine room 36 and drawn into the intake opening $\mathbf{79}_1$ in the intake silencer 76, but also by the air discharged through the engine room 36 via the belt chamber 68 to the outside and therefore, it is possible to alleviate the influence provided to the surrounding devices such as the endless belts 46, 54 and 65 by the heat emitted by the generator 62.

Further, since the generator 62 is disposed in the space between the front surface of the engine E and the engine cover 4, it is possible to maintain the lateral dimension (the width) of the outboard engine system O to the minimum. This is advantageous for space, when the outboard engine system O is steered so that it is turned to the left or right, or when the two outboard engine systems 0 are used in a tandem manner.

In addition, the intake manifold 85 is disposed in the space between the right side of the engine E and the engine cover 4; the exhaust passage $\mathbf{8}_4$ is defined in the left side of the engine E, and the electric equipment box 96 is disposed in the space between such left side and the engine cover 4. Therefore, the spaces on the left and right of the engine E can be utilized with a good balance to suppress the increase in lateral dimension of the outboard engine system O. Especially, the electric equipment box 96 is formed with the lateral dimension which is small, as compared with its longitudinal and vertical dimensions, which can contribute to a reduction in lateral dimension of the outboard engine system O.

Further, the generator 62, the throttle body 80 and the cartridge-type oil filter 97 are disposed on the front surface of the engine E, wherein the cartridge-type oil filter 97 is disposed at a location lower than the generator 62, and the cartridge-type oil filter 97 and the generator 62 are disposed in the laterally distributed manner. Thus, the space between the front surface of the engine E and the engine cover 4 can be utilized effectively to reduce the size of the outboard engine system O.

In the intake system, the surge tank 82 is located on the side of the engine E and hence, it is unnecessary to increase the length of the intake pipes 83*a*, 83*b*, 83*c* and 83*d* uselessly, which is effective for increasing the output in a range of high rotation of the engine E. Moreover, the throttle body 80 can be disposed on the front surface of the engine E by virtue of the elbow 81 and hence, it is possible to reduce the size of projection of the throttle body 80 from the surge tank 82, as compared with the case where the surge tank 82 and the throttle body 80 are longitudinally connected to each other to provide a rectilinear flow of the intake air. Further, the body portion 78 of the intake silencer 76 is of an L-shape as viewed from the front (see FIG. 4), and the intake duct 35, the throttle body 80 and the elbow 81 are connected to that upper portion of the body portion 78 which has a small lateral width. Therefore, it is possible to avoid the interference of the generator 62 and the cartridge-type oil filter 97 with each other, while ensuring a sufficient volume of the intake silencer 76.

Although the embodiment of the present invention has been described in detail, it will be understood that the present invention is not limited to the above-described embodiment, and various modifications may be made without departing from the spirit and scope of the invention defined in claims. For example, the outboard engine system O having the in-line type 4-cylinder engine E mounted thereon has been illustrated in the embodiment, but the present invention is also applicable to an outboard engine system provided with an engine other than the in-line type 4-cylinder engine E. The generator 62 has been disposed on the front surface of the engine body in the embodiment, but even if the generator 62 is disposed on the rear surface of the engine body, a similar function and effect can be provided.

What is claimed is:

1. An outboard engine system comprising an engine (E), an intake system auxiliary (76) and a generator (62) which are accommodated within an engine room (36) covered with an engine cover (4) having an air intake port ($4_1$), characterized in that said generator (62) is disposed in an intermediate portion of a path of air flow from said air intake port ($4_1$) to an intake opening ($79_1$) in said intake system auxiliary (76).

2. An outboard engine system comprising an engine (E), an intake system auxiliary and a generator (62) which are accommodated within an engine room (36) covered with an engine cover (4) having an air intake port ($4_1$) and a ventilation port ($75_1$), characterized in that said generator (62) is disposed in an intermediate portion of a path of air flow from said air intake port ($4_1$) to said ventilation port ($75_1$).

3. An outboard engine system comprising an engine (E), an intake system auxiliary (76) and a generator (62) which are accommodated within an engine room (36) covered with an engine cover (4) having an air intake port ($4_1$) and a ventilation port ($75_1$), characterized in that said generator (62) is disposed in an intermediate portion of a path of air flow from said air intake port ($4_1$) to an intake opening ($79_1$) in said intake system auxiliary (76) and in an intermediate portion of a path of air flow from said air intake port ($4_1$) to said ventilation port ($75_1$).

4. An outboard engine system comprising an engine (E) accommodated within an engine room (36) covered with an engine cover (4), and a generator (62) disposed on an axis different from that of a crankshaft (15) of said engine (e) and driven by said crankshaft (15), characterized in that said generator (62) is disposed between a front or rear surface of an engine block (6, 7, 8) and an inter surface of said engine cover (4) wherein said generator (62) is disposed in an intermediate portion of a path of air flow from an air intake port ($4_1$) in said cover (4) to an intake opening ($79_1$) in an intake system auxiliary (76).

5. An outboard engine system according to claim 4, characterized in that an intake passage (85) is disposed longitudinally along a side of said engine block (6, 7, 8).

6. An outboard engine system according to claim 4, characterized in that an intake passage (85) is disposed longitudinally along one of left and right sides of said engine block (6, 7, 8), and an exhaust passage ($8_4$) is defined vertically on the other side.

7. An outboard engine system according to claim 4, characterized in that an electric equipment box (96) is disposed along a side of said engine block (6, 7, 8), the lateral dimension of said electric equipment box (96) being smaller than the longitudinal and vertical dimensions of said electric equipment box (96).

8. An outboard engine system according to claim 4, characterized in that an intake passage (85) is disposed longitudinally along one of left and right sides of said engine block (6, 7, 8), and an electric equipment box (96) is disposed along the other side of said engine block (6, 7, 8), the lateral dimension of said electric equipment box (96) being smaller than the longitudinal and vertical dimensions of said electric equipment box (96).

9. An outboard engine system according to claim 4, characterized in that an intake passage (85) is disposed longitudinally along one of left and right sides of said engine block (6, 7, 8); an exhaust passage ($8_4$) is defined vertically on the other side of said engine block (6, 7, 8); and an electric equipment box (96) is disposed along the other side of said engine block (6, 7, 8), the lateral dimension of said electric equipment box (96) being smaller than the longitudinal and vertical dimensions of said electric equipment box (96).

10. An outboard engine system according to claim 4, characterized in that an oil filter (97) and said generator (62) are disposed in a vertically distributed manner on the front or rear surface of said engine block (6, 7, 8).

11. An outboard engine system according to claim 4, characterized in that an oil filter (97) and said generator (62) are disposed in a laterally distributed manner on the front or rear surface of said engine block (6, 7, 8).

12. An outboard engine system according to claim 1, wherein said generator is disposed on an axis different from that of an engine crankshaft.

13. An outboard engine system according to claim 2, wherein said generator is disposed on an axis different from that of an engine crankshaft.

14. An outboard engine system according to claim 3, wherein said generator is disposed on an axis different from that of an engine crankshaft.

* * * * *